US009103570B2

(12) United States Patent
Jang et al.

(10) Patent No.: US 9,103,570 B2
(45) Date of Patent: Aug. 11, 2015

(54) REFRIGERANT SYSTEM AND METHOD FOR CONTROLLING THE SAME

(75) Inventors: Jiyoung Jang, Seoul (KR); Baikyoung Chung, Seoul (KR); Sedong Chang, Seoul (KR); Junseong Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1031 days.

(21) Appl. No.: 13/007,218

(22) Filed: Jan. 14, 2011

(65) Prior Publication Data

US 2011/0174002 A1 Jul. 21, 2011

(30) Foreign Application Priority Data

Jan. 15, 2010 (KR) ..... 10-2010-0004089

(51) Int. Cl.
*F25B 13/00* (2006.01)

(52) U.S. Cl.
CPC ..... *F25B 13/00* (2013.01); *F25B 2313/023* (2013.01); *F25B 2313/0231* (2013.01); *F25B 2313/0294* (2013.01); *F25B 2313/02732* (2013.01); *F25B 2700/1931* (2013.01); *F25B 2700/1933* (2013.01); *F25B 2700/21151* (2013.01); *F25B 2700/21152* (2013.01)

(58) Field of Classification Search
CPC ..... F25B 2313/0292; F25B 2313/0294; F25B 2600/111; F25B 2600/112; F25B 2700/172; F25B 2700/173
USPC ..... 62/126, 159, 160, 324.6
See application file for complete search history.

(56) References Cited

U.S. PATENT DOCUMENTS

| | | | | |
|---|---|---|---|---|
| 4,698,981 | A * | 10/1987 | Kaneko et al. | 62/180 |
| 4,878,357 | A * | 11/1989 | Sekigami et al. | 62/160 |
| 7,028,502 | B2 * | 4/2006 | Takegami et al. | 62/324.6 |
| 2004/0134206 | A1 * | 7/2004 | Lee et al. | 62/157 |
| 2005/0150243 | A1 * | 7/2005 | Matsuoka et al. | 62/324.1 |
| 2006/0218948 | A1 | 10/2006 | Otake et al. | 62/160 |
| 2008/0022710 | A1 * | 1/2008 | Jeong et al. | 62/324.6 |
| 2008/0092572 | A1 * | 4/2008 | Kim | 62/160 |

FOREIGN PATENT DOCUMENTS

| | | |
|---|---|---|
| KR | 10-0188860 | 6/1999 |
| KR | 10-2006-0025827 | 3/2006 |

OTHER PUBLICATIONS

European Search Report dated Oct. 29, 2014, issued in Application No. 11150697.8.

* cited by examiner

*Primary Examiner* — Jonathan Bradford
(74) *Attorney, Agent, or Firm* — Ked & Associates, LLP

(57) ABSTRACT

A refrigerant system includes an outdoor unit and a plurality of indoor units. The outdoor unit has a compressor and a plurality of heat exchangers and each indoor unit has a heat exchanger. A detector detects pressures at an inflow side and a discharge side of the compressor, and a controller controls a direction of refrigerant flow for the heat exchangers of the outdoor unit. This may involve changing the refrigerant flow direction for at least one of the heat exchanger of the outdoor unit based on the detected pressures.

10 Claims, 9 Drawing Sheets

REFRIGERANT SYSTEM AND METHOD FOR CONTROLLING THE SAME

CROSS-REFERENCE TO RELATED APPLICATIONS

The present application claims priority under 35 U.S.C. 119 and 35 U.S.C. 365 to Korean Patent Application No. 10-2010-0004089 filed on Jan. 15, 2010, which is hereby incorporated by reference in its entirety.

BACKGROUND

1. Field

One or more embodiments disclosed herein relate to refrigeration.

2. Background

A refrigerant system is a device that cools or heats an interior space by performing a refrigerant cycle including compression, condensation, expansion and evaporation of refrigerant.

Typically, a refrigerant system includes an indoor unit in which a refrigerant is heat-exchanged with indoor air and an outdoor unit in which a refrigerant is heat-exchanged with outdoor air. The indoor unit includes an indoor heat exchanger for performing heat-exchange between the refrigerant and the indoor air, a fan blowing the indoor air, and a motor rotating the fan. The outdoor includes an outdoor heat exchanger for performing heat-exchange between the refrigerant and the outdoor air, a fan for blowing the outdoor air, a motor for rotating the fan, a compressor for compressing the refrigerant, an expansion part for expanding the compressed refrigerant, and a four-way valve for switching a flow direction of the refrigerant.

When an interior space is cooled, the indoor heat exchanger serves as an evaporator, and the outdoor heat exchanger serves as a condenser. When the interior space is heated, the indoor heat exchanger serves as a condenser, and the outdoor heat exchanger serves as an evaporator. The four-way valve switches a refrigerant flow direction to switch the cooling and heating operations.

DETAILED DESCRIPTION

Figure 1:
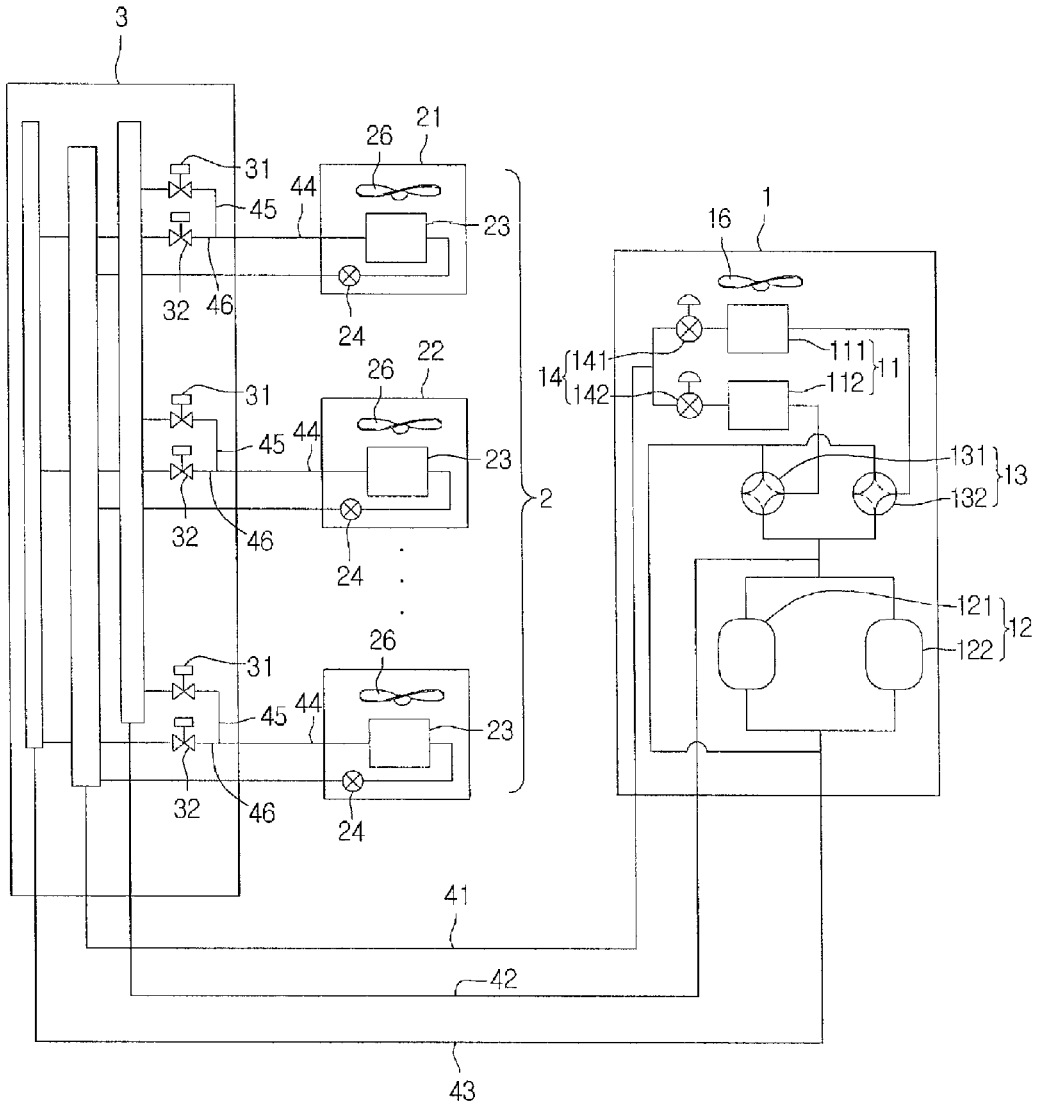
FIG. 1 shows one embodiment of a refrigerant system.

FIG. 1 is a schematic configuration view of a refrigerant system according to an embodiment. Referring to FIG. 1, a refrigerant system includes an outdoor unit 1 disposed in an outdoor space and exposed to outdoor air, a plurality of indoor units 2 disposed in an indoor space and exposed to indoor air, a distributor 3 connecting the outdoor unit 1 to the plurality of indoor units 2, and a refrigerant tube through which a refrigerant flows among the outdoor unit 1, the indoor units 2, and the distributor 3.

In detail, the outdoor unit 1 includes an outdoor heat exchanger 11 in which the outdoor air and the refrigerant are heat-exchanged with each other, an outdoor fan 16 for forcibly blowing the outdoor air toward the outdoor heat exchanger 11, a compressor 12 compressing the refrigerant, a flow switch part 13 switching a flow direction of the refrigerant discharged from the compressor 12, and an outdoor expansion part 14 selectively expanding the refrigerant flowing into the outdoor heat exchanger 11.

The outdoor heat exchanger 11 includes a first outdoor heat exchange unit 111 and a second outdoor heat exchange unit 112, which are exposed to the outdoor air within the outdoor unit 1. The first outdoor heat exchange unit 111 and the second outdoor heat exchange unit 112 may selectively serve as an evaporator in which the refrigerant is evaporated or a condenser in which the refrigerant is condensed according to operation modes of the refrigerant system. The first outdoor heat exchange unit and second outdoor heat exchange unit 112 are connected to each other in parallel on the refrigerant tube.

The outdoor fan 16 continuously supplies the outdoor air into the outdoor heat exchanger 11 to heat-exchange the outdoor air with the refrigerant in the outdoor heat exchanger 11. Here, the outdoor unit 1 may further include an outdoor motor (not shown) providing a power for rotating the outdoor fan 16.

The compressor 12 includes a constant speed compressor 121 operated at a constant speed to compress the refrigerant and an inverter compressor 122 operated at a variable speed to compress the refrigerant. The constant speed compressor 121 and the inverter compressor 122 are connected to each other in parallel.

The flow switch part 13 includes a first flow switch part 131 and a second flow switch part 132, which are disposed in the refrigerant tube corresponding to a discharge side of the compressor 12. The first flow switch part 131 and the second flow switch part 132 are connected to each other in parallel to respectively correspond to the first outdoor heat exchange unit 111 and the second outdoor heat exchange unit 112. That is, the first flow switch part 131 is connected to the first outdoor heat exchange unit 111 in series, and the second flow switch part 132 is connected to the second outdoor heat exchange unit 112 in series.

In more detail, the first flow switch part 131 allows the refrigerant tube connected to the first outdoor heat exchange unit 111 to selectively communicate with one of the refrigerant tube corresponding to the discharge side of the compressor 12 and the refrigerant tube corresponding to an inflow side of the compressor 12. That is, the refrigerant discharged from the compressor 12 may flow into the first outdoor heat exchange unit 111 or the refrigerant passing through the first outdoor heat exchange unit 111 may flow into the compressor 12 according to the switching operation of the first flow switch part 131.

Also, the second flow switch part 132 allows the refrigerant tube connected to the second outdoor heat exchange unit 112 to selectively communicate with one of the refrigerant tube corresponding to the discharge side of the compressor 12 and the refrigerant tube corresponding to the inflow side of the compressor 12. That is, the refrigerant discharged from the compressor 12 may flow into the second outdoor heat exchange unit 112 or the refrigerant passing through the second outdoor heat exchange unit 112 may flow into the compressor 12 according to the switching operation of the second flow switch part 132.

The outdoor expansion part 14 is disposed in the refrigerant tube corresponding to a position adjacent to the outdoor heat exchanger 11. Particularly, the outdoor expansion part 14 is disposed in the refrigerant tube connecting the outdoor heat exchanger 11 to the distributor 3.

In more detail, the outdoor expansion part 14 includes a first outdoor expansion part 141 disposed in the refrigerant tube corresponding to a position adjacent to the first outdoor heat exchange unit 111 and a second outdoor expansion part 142 disposed in the refrigerant tube corresponding to a position adjacent to the second outdoor heat exchange unit 112. When the refrigerant system is operated to allow the first outdoor heat exchange unit 111 to serve as the evaporator, the refrigerant discharged from the distributor 3 is expanded while passing through the first outdoor expansion part 141 before it is introduced into the first outdoor heat exchange unit 111. Also, when the refrigerant system is operated to allow the second outdoor heat exchange unit 112 to serve as the evaporator, the refrigerant discharged from the distributor 3 is expanded while passing through the second outdoor expansion part 142 before it is introduced into the second outdoor heat exchange unit 112.

Each of the plurality of indoor units 2 includes an indoor heat exchanger 23 in which the indoor air and the refrigerant are heat-exchanged with each other, an indoor fan 26 for forcibly blowing the indoor air toward the indoor heat exchanger 23, and an indoor expansion part 24 for expanding the refrigerant flowing into the indoor heat exchanger 23. That is, the refrigerant system includes a plurality of indoor heat exchangers 23 and a plurality of indoor expansion parts 24 respectively corresponding to the plurality of indoor heat exchangers 23 as a whole.

The distributor 3 is connected to both the outdoor unit 1 and the plurality of indoor units 2. The distributor 3 distributes the refrigerant discharged from the outdoor unit 1 into the plurality of indoor units. Also, the distributor 3 switches a flow direction of the refrigerant within the indoor units 2 according to the operation modes of the refrigerant system.

The refrigerant tube includes a high-pressure tube 42 guiding the refrigerant discharged from the compressor 12 to the distributor 3, a low-pressure tube 43 guiding the refrigerant evaporated by at least one of the indoor units 2 to the compressor 12, and a liquid refrigerant tube 41 through which the refrigerant condensed within the indoor units 2 or the outdoor unit 1 flows, and an indoor unit tube 44 connecting the distributor 3 to the indoor units 2.

The high-pressure tube 42, the low-pressure tube 43, and the liquid refrigerant tube 41 connect the outdoor unit 1 to the distributor 3. Alternatively, the high-pressure tube 42 is branched from the refrigerant tube corresponding to the discharge side of the compressor 12 to extend up to the inside of the distributor 3. The low-pressure tube 43 is connected to the refrigerant tube corresponding to the inflow side of the compressor 12 to extend up to the inside of the distributor 3. Also, the liquid refrigerant tube 41 is connected to the outdoor expansion part 14 to extend up to the inside of the distributor 3.

The distributor 3 includes a plurality of high-pressure branch tubes 45 respectively guiding the refrigerant within the high-pressure tube 42 to the plurality of indoor heat exchangers 23, a plurality of low-pressure branch tubes 46 respectively guiding the refrigerant within the plurality of outdoor heat exchangers 11 to the low-pressure tube 43, and high-pressure and low-pressure valves 31 and 32 respectively selectively interrupting the refrigerant flows within the high-pressure and low-pressure branch tubes 45 and 46.

That is, the high-pressure branch tube 45 is branched from the high-pressure tube 42, and the low-pressure branch tube 46 is branched from the low-pressure tube 43. The high-pressure valve 31 and the low-pressure valve 32 are disposed in the high-pressure branch tube 45 and the low-pressure branch tube 46, respectively.

The indoor unit tube 44 has one end connected to the liquid refrigerant tube 41 and the other end connected to both the high-pressure branch tube 45 and the low-pressure branch tube 46. Also, the indoor heat exchanger 23 and the indoor expansion part 24 are disposed on the indoor unit tube 44. That is, the indoor unit tube 44 connects indoor heat exchanger 23 to both the high-pressure and low-pressure branch tubes 45 and 46.

Also, according to the operation modes of the indoor unit 2, the refrigerant of the liquid refrigerant tube 41 may successively pass through the indoor expansion part 24 and the indoor heat exchanger 23 to flow into the low-pressure branch tube 46. Alternatively, the refrigerant of the high-pressure branch tube 45 may successively pass through the indoor heat exchanger 23 and the indoor expansion part 24 to flow into the liquid refrigerant tube 41.

Hereinafter, a refrigerant flow in the refrigerant system according to an embodiment will be described in detail with reference to accompanying drawings.

Figure 2:
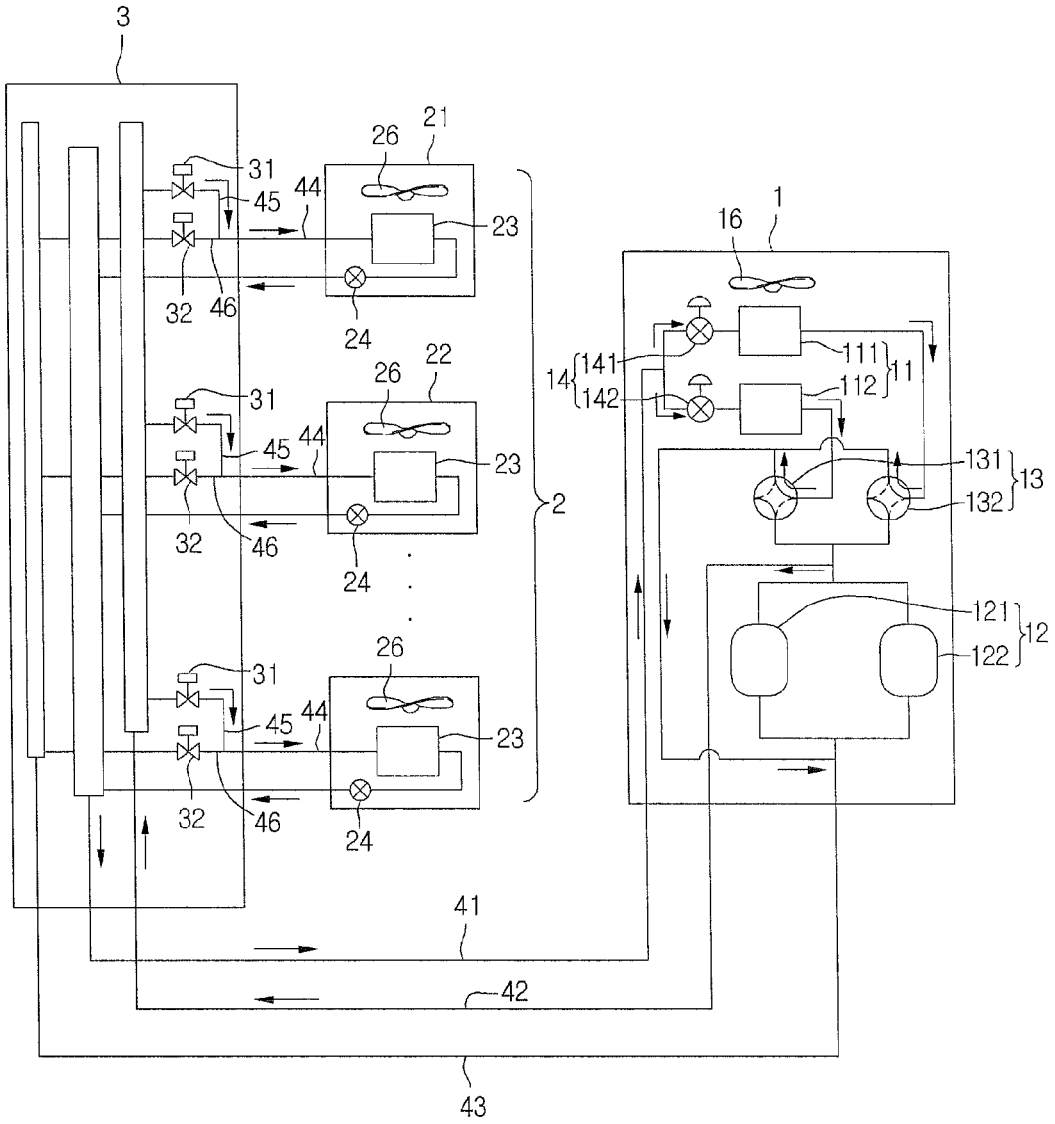
FIG. 2 shows refrigerant flow in a full heating mode.
Figure 3:
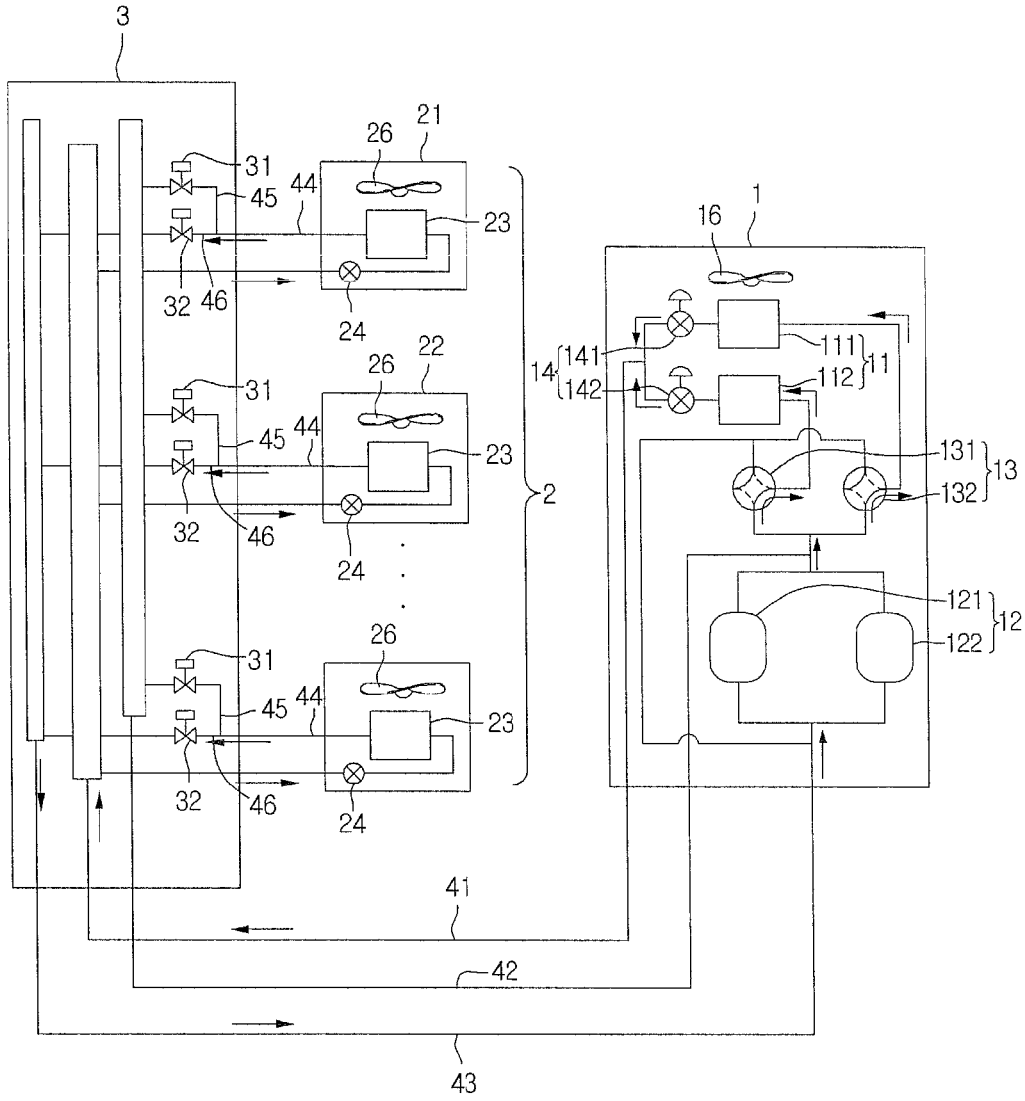
FIG. 3 shows refrigerant flow in full cooling mode.
Figure 4:
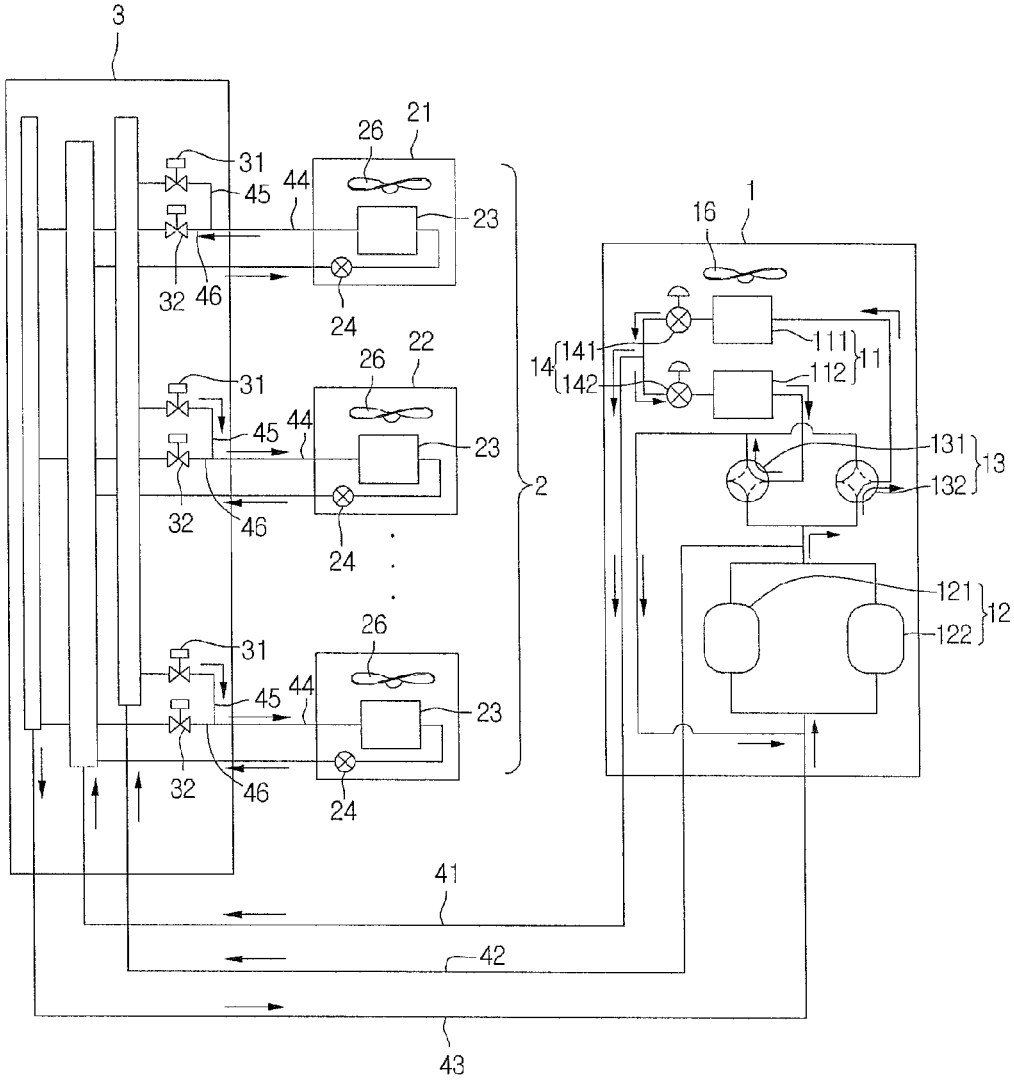
FIG. 4 shows refrigerant flow in a simultaneous heating/cooling mode.

FIG. 2 is a schematic configuration view illustrating a refrigerant flow when a refrigerant system is operated in a full heating mode according to an embodiment. FIG. 3 is a schematic configuration view illustrating a refrigerant flow when a refrigerant system is operated in a full cooling mode according to an embodiment. FIG. 4 is a schematic configuration view illustrating a refrigerant flow when a refrigerant system is operated in a simultaneous heating/cooling mode according to an embodiment.

Referring to FIG. 2, the whole indoor units 2 the refrigerant system may be operated to perform an indoor heating operation. Here, a case in which the whole indoor units 2 of the refrigerant system are operated to perform the indoor heating operation is referred to as a "full heating operation".

When the refrigerant system performs the full heating operation, the refrigerant discharged from the compressor 12 flows into the distributor 3 along the high-pressure tube 42. The refrigerant flowing into the distributor 3 is introduced into the high-pressure branch tube 45 corresponding to each of the plurality of indoor units 2. Then, the refrigerant is introduced into the high-pressure branch tube 45 corresponding to the whole indoor units 2 of the refrigerant system.

The refrigerant flowing into the high-pressure branch tube 45 passes through the indoor heat exchanger 23 along the indoor unit tube 44. When the refrigerant passes through the indoor heat exchanger 23, the refrigerant radiates heat into the indoor air and is condensed. The refrigerant passing through the indoor heat exchanger 23 is introduced into the liquid refrigerant tube 41 via the indoor expansion part 24. Here, since the indoor expansion part 24 is maintained in a fully opened state, the refrigerant passes through the indoor expansion part 24 without changing a phase thereof.

The refrigerant flowing into the liquid refrigerant tube 41 is introduced into the outdoor expansion part 14 along the liquid refrigerant tube 41. Here, the outdoor expansion part 14 is maintained in a partially opened state. Thus, the refrigerant is expanded while passing through the outdoor expansion part 14. Also, the refrigerant passing through the outdoor expansion part 14 absorbs heat from the outdoor air and is evaporated while passing through the outdoor heat exchanger 11.

The refrigerant passing through the outdoor heat exchanger 11 in introduced into the compressor 12. Here, the flow switch part 13 is maintained in a state in which the refrigerant tube connected to the outdoor heat exchanger 11 communicates with the refrigerant tube corresponding to the inflow side of the compressor 12.

In more detail, the refrigerant passing through the liquid refrigerant tube 41 is introduced into the first outdoor expansion part 141 and the second expansion part 142. The refrigerant is expanded while passing through the first outdoor expansion part 141 and the second expansion part 142. The refrigerant passing through the first outdoor expansion part 141 and the second expansion part 142 is respectively introduced into the first outdoor heat exchange unit 111 and the second outdoor heat exchange unit 112. The refrigerant absorbs heat from the outdoor air and is evaporated while passing through the first outdoor heat exchange unit 111 and the second outdoor heat exchange unit 112. Also, the refrigerant passing through the first outdoor heat exchange unit 111 and the second outdoor heat exchange unit 112 is introduced together into the compressor 12. Here, the first flow switch part 13 and the second flow switch part 13 are maintained in a state in which the refrigerant tube connected to the first outdoor heat exchange unit 111 and the refrigerant tube connected to the second outdoor heat exchange unit 112 communicate with the refrigerant tube corresponding to the inflow side of the compressor 12, respectively.

The refrigerant flowing into the compressor 15 is compressed again while passing therethrough.

These processes may be repeatedly performed to realize the full heating operation of the refrigerant system. That is, when the refrigerant system performs the full heating operation, the whole indoor heat exchangers 23 serve as the condenser, and the whole indoor heat exchange units 111 and 112 serve as the evaporator.

The whole indoor units 2 of the refrigerant system may be operated for cooling the indoor room. Here, a case in which the whole indoor units 2 of the refrigerant system are operated to perform an indoor cooling operation is referred to as a "full cooling operation."

Referring to FIG. 3, when the refrigerant system performs the cooling operation, the refrigerant discharged from the compressor 12 is introduced into the outdoor heat exchanger 11. Here, the flow switch part 13 is maintained in a state in which the refrigerant tube connected to the outdoor heat exchanger 11 communicates with the refrigerant tube corresponding to the discharge side of the compressor 12.

The refrigerant passing through the outdoor heat exchanger 11 passes through the outdoor expansion part 14 and is introduced into the liquid refrigerant tube 41. Here, the outdoor expansion part 14 is maintained in a fully opened state to allow the refrigerant to pass through the outdoor expansion part 14 without changing a phase thereof.

In detail, the refrigerant discharged from the compressor 12 is divided and introduced into the first outdoor heat exchange unit 111 and the second outdoor heat exchange unit 112. Here, the first flow switch part 131 is maintained in a state in which the refrigerant tube connected to the first outdoor heat exchange unit 111 communicates with the refrigerant tube corresponding to the discharge side of the compressor 12. Also, the second flow switch part 132 is maintained in a state in which the refrigerant tube connected to the second outdoor heat exchange unit 112 communicates with the refrigerant tube corresponding to the discharge side of the compressor 12. Thus, a portion of the refrigerant discharged from the compressor 12 is guided to the first outdoor heat exchange unit 111 by the first flow switch part 131, and the rest refrigerant is guided to the second outdoor heat exchange unit 112 by the second flow switch part 132.

The refrigerant radiates heat into the outdoor air and is condensed while passing through the first outdoor heat exchange unit 111 and the second outdoor heat exchange unit 112. The refrigerant passing through the first outdoor heat exchange unit 111 passes through the first outdoor expansion part 141, and the refrigerant passing through the second outdoor heat exchange unit 112 passes through the second outdoor expansion part 142. Here, the first outdoor expansion part 141 and the second outdoor expansion part 142 are maintained in fully opened states to allow the refrigerant to pass through the first outdoor expansion part 141 and the second outdoor expansion part 142 without change their phases, respectively.

The refrigerant passing through the first outdoor expansion part 141 and the second outdoor expansion part 142 is introduced into the liquid refrigerant tube 41. Also, the refrigerant flows into the distributor 3 along the liquid refrigerant tube 41.

The refrigerant within the liquid refrigerant tube 41 successively passes through the indoor expansion part 24 and the indoor heat exchanger 23 along the indoor unit tube 44. Here, the indoor expansion part 24 is maintained in a partially opened state to allow the refrigerant to be expanded while passing through the indoor expansion part 24. The refrigerant absorbs heat from the indoor air is evaporated while passing through the indoor heat exchanger 23.

The refrigerant passing through the indoor heat exchanger 23 is introduced into the low-pressure branch tube 47. Here, the high-pressure valve 31 is closed, and the low-pressure valve 32 is opened. Then, the refrigerant is introduced into the low-pressure branch tube 47 corresponding to each of the indoor units of the refrigerant system.

The refrigerant passing through the low-pressure branch tube 47 is introduced into the low-pressure tube 43. The refrigerant flows into the outdoor unit 1 through the low-pressure tube 43. Alternatively, the refrigerant flowing through the low-pressure tube 43 is introduced into the compressor 12. Then, the refrigerant is compressed again while passing through the compressor 12.

There processes may be repeatedly performed to realize the full cooling operation of the refrigerant system. That is, when the refrigerant system performs the full cooling operation, the whole indoor heat exchangers 23 serve as the evaporator, and the whole indoor heat exchange units 111 and 112 serve as the condenser.

A portion of the indoor units 2 of the refrigerant system may be operated for heating the indoor room, and the rest indoor units 2 may be operated for cooling the indoor room. In this case, this is referred to as a simultaneous cooling/heating operation".

Referring to FIG. 4, when the refrigerant system performs the simultaneous cooling/heating operation, the refrigerant discharged from the compressor 12 flows toward the high-pressure tube 42 and the first outdoor heat exchange unit 111. Here, the first flow switch part 13 is maintained in a state in which the refrigerant tube connected to the first outdoor heat exchange unit 111 communicates with the refrigerant tube corresponding to the discharge side of the compressor 12.

The refrigerant flowing into the high-pressure tube 42 is introduced into the indoor unit 2 operated for heating the indoor room among the plurality of indoor units 2 through the high-pressure branch tube 45 and the indoor unit tube 44. The refrigerant flowing into the indoor unit 2 passes through the indoor heat exchanger 23 and the indoor expansion part 24 and is introduced into the rest indoor units operated for cooling the indoor room along the liquid refrigerant tube 41. Here, the indoor expansion part 24 is maintained in a fully opened state, and the refrigerant passes through the indoor expansion part 24 without changing a phase thereof.

The refrigerant flowing into the first outdoor heat exchange unit 111 radiates heat into the outdoor air is condensed while passing through the first outdoor heat exchange unit 111. The refrigerant passing through the first outdoor heat exchange unit 111 is introduced into the first outdoor expansion part 141. Here, the first outdoor expansion part 141 is maintained in a fully opened state, and the refrigerant passes through the first outdoor expansion part 141 without changing a phase thereof.

The refrigerant passing through the first outdoor expansion part 141 flows toward the liquid refrigerant tube 41 and the second outdoor expansion part 142. The refrigerant flowing along the liquid refrigerant tube 41 is combined with the refrigerant discharged from the indoor unit 2 operated for heating the indoor room. Thereafter, the refrigerant is introduced into the rest indoor units 2 operated for cooling the indoor room.

The refrigerant flowing into second outdoor expansion part 142 is expanded while passing through the second outdoor expansion part 142. That is, second outdoor expansion part 142 may be maintained in a partially opened state to expand the refrigerant.

The refrigerant passing through the second outdoor expansion part 142 absorbs heat from the outdoor air is evaporated while passing through the second outdoor heat exchange unit 112. The refrigerant passing through the second outdoor heat exchange unit 112 is introduced into the compressor 12. Here, the second flow switch part 132 allows the refrigerant tube connected to the second outdoor heat exchange unit 112 to communicate with the refrigerant tube corresponding to the inflow side of compressor 12.

The refrigerant flowing into the rest indoor units 2 operated for cooling the indoor room is expanded while passing through the indoor expansion part 24. Thereafter, the refrigerant absorbs heat from the indoor air is evaporated while passing through the indoor heat exchanger 23. The refrigerant passing through the indoor heat exchanger 23 is introduced into the low-pressure tube 43 via the indoor unit tube 44 and the low-pressure branch tube 46.

The refrigerant flowing into the low-pressure tube 43 is introduced into the compressor 12 along the low-pressure tube 43. That is, the refrigerant is combined with the refrigerant passing through the second outdoor heat exchange unit 112 to flow again into the compressor 15. The refrigerant flowing into the compressor 15 passes through the compressor 12 and is compressed again.

Through these processes, the refrigerant system may perform the simultaneous cooling/heating operation. That is, a portion of the indoor heat exchangers 23 of the refrigerant system may serve as the condenser, and the rest indoor heat exchangers 23 may serve as the evaporator. Also, a portion 111 of the outdoor heat exchange units 111 and 112 of the refrigerant system may serve as the condenser, and the rest of the outdoor heat exchange unit 112 may serve as the evaporator.

Hereinafter, a method for controlling the refrigerant system according to an embodiment will be described in detail with reference to the accompanying drawings.

Figure 5:
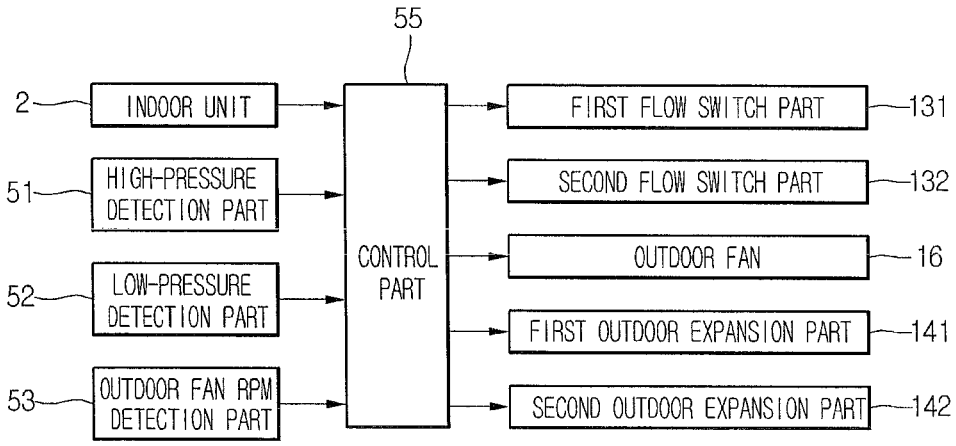
FIG. 5 shows a refrigerant system according to an embodiment.
Figure 6:
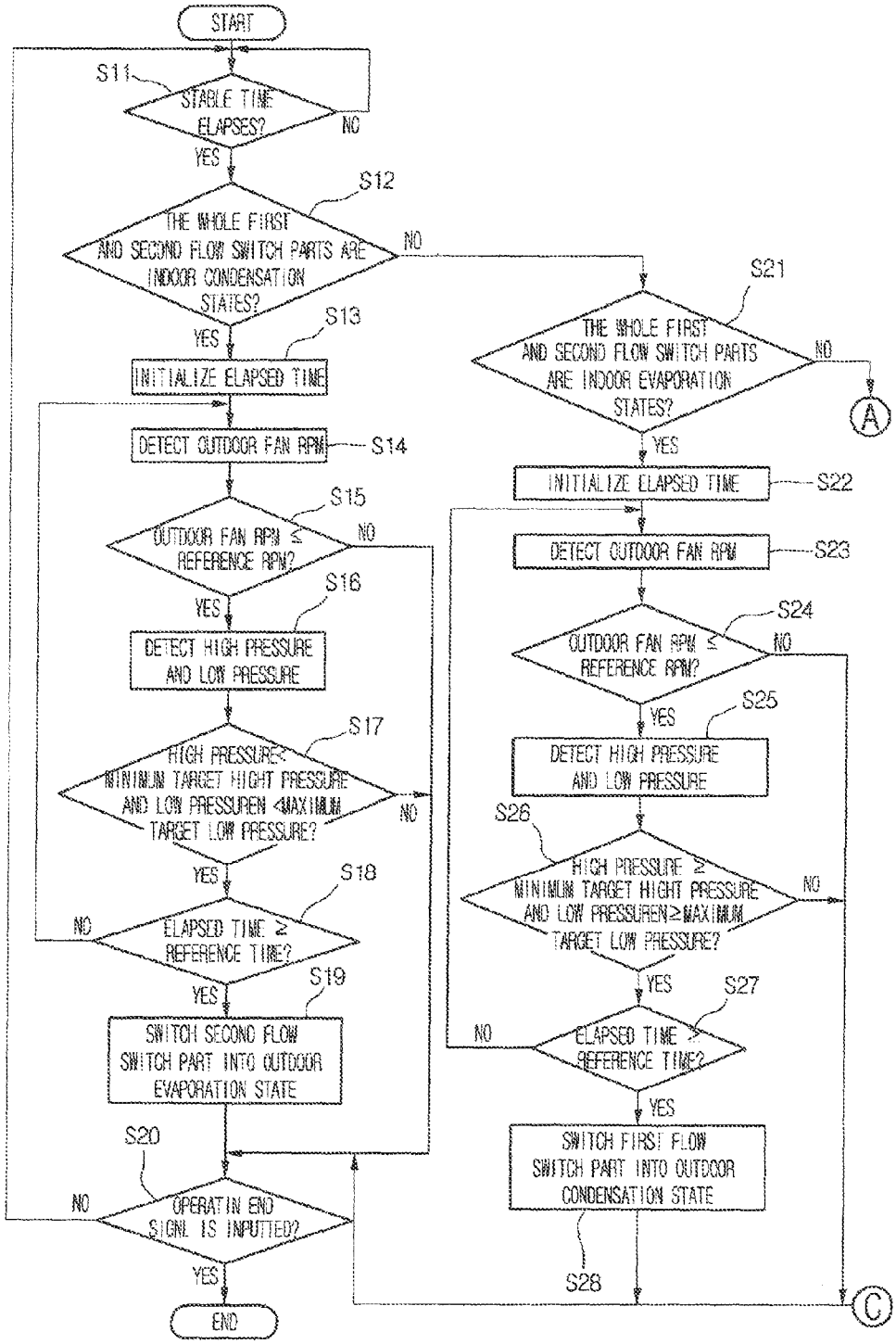
FIG. 6 shows an embodiment of a method for controlling a refrigerant system.
Figure 7:
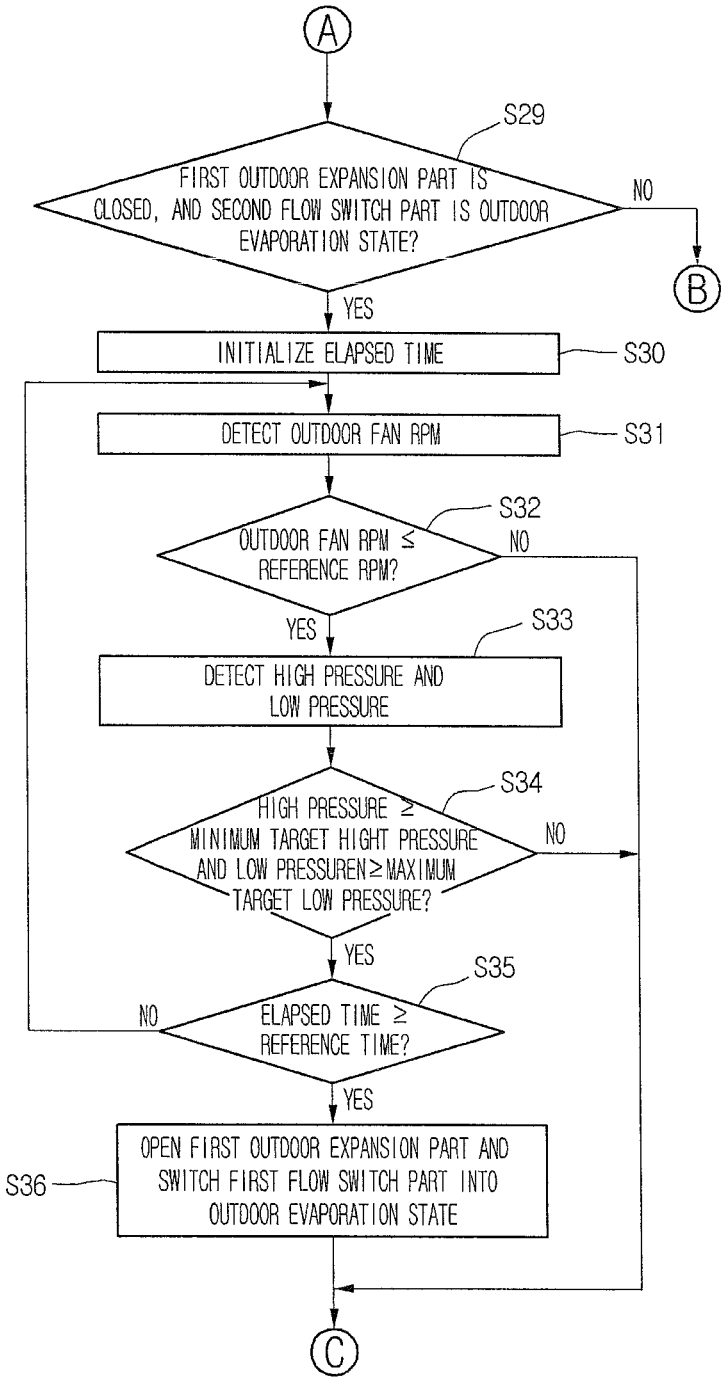
FIG. 7 shows an embodiment of a method for controlling a refrigerant system.
Figure 8:
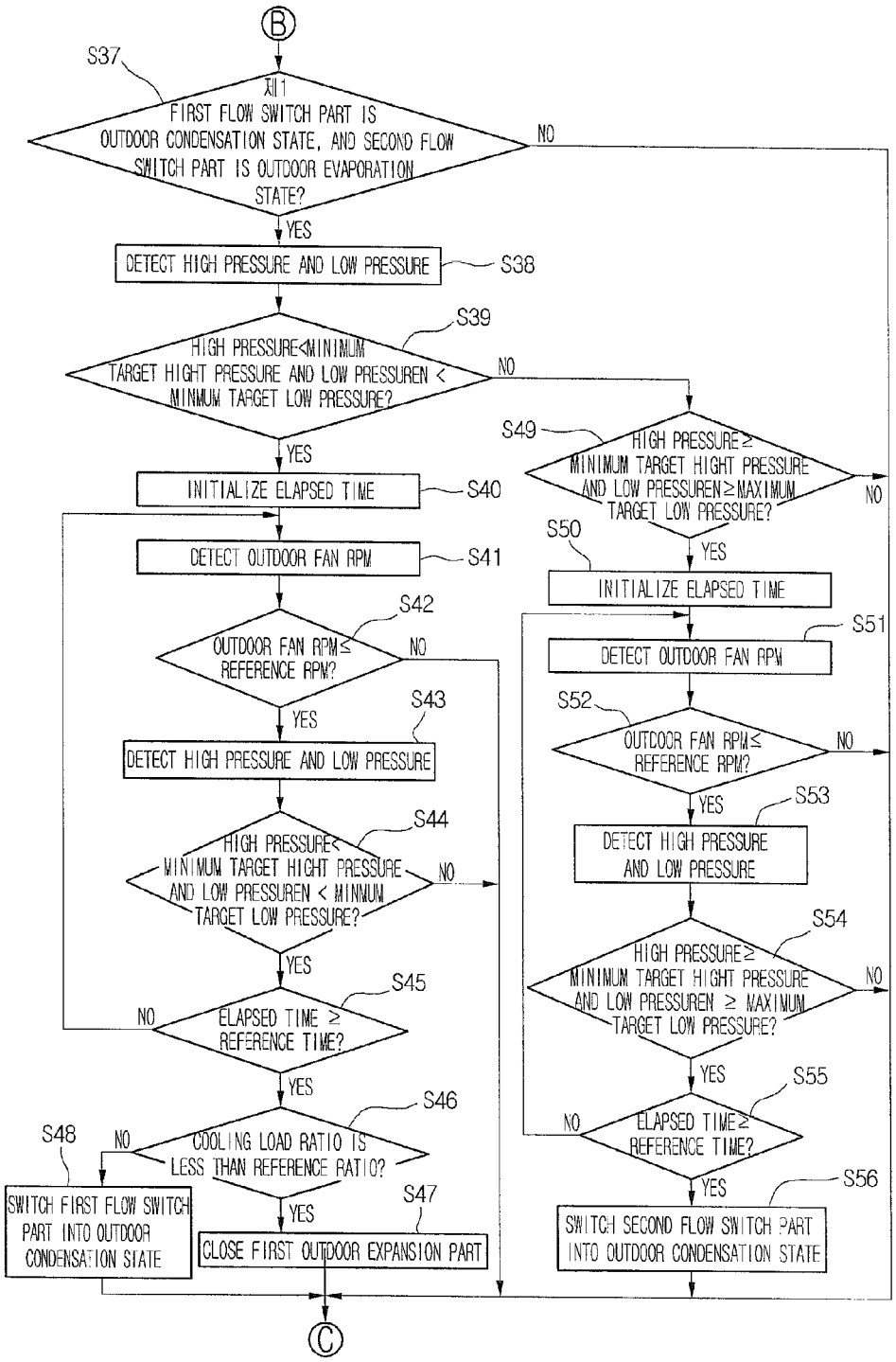
FIG. 8 shows an embodiment of a method for controlling a refrigerant system.
Figure 9:
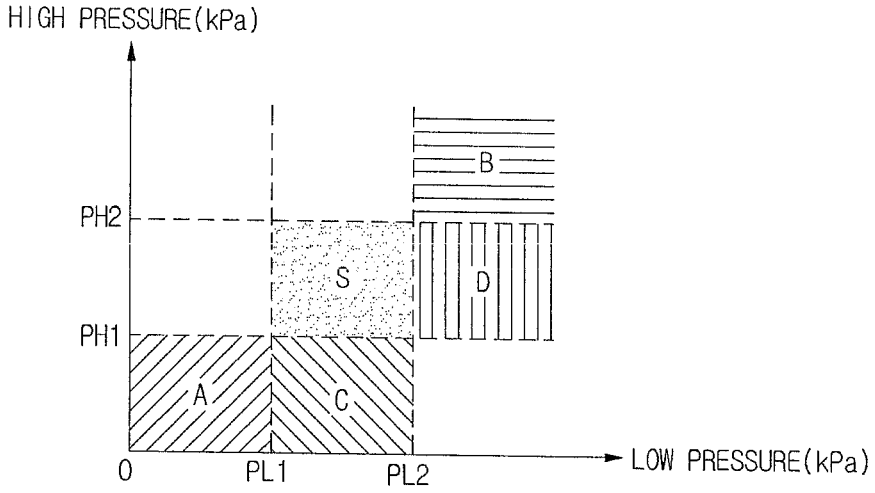
FIG. 9 is a graph illustrating input conditions in which a flow switch part is switched in a refrigerant system.

FIG. 5 is a control configuration view of a refrigerant system according to an embodiment. FIG. 6 is a flowchart illustrating a method for controlling a refrigerant system according to an embodiment. FIG. 7 is a flowchart illustrating a method for controlling a refrigerant system according to an embodiment. FIG. 8 is a flowchart illustrating a method for controlling a refrigerant system according to an embodiment. FIG. 9 is a graph illustrating input conditions in which a flow switch part is switched in a refrigerant system according to an embodiment.

Referring to FIG. 5, the refrigerant system according to the current embodiment further includes pressure detection parts 51 and 52 for detecting refrigerant pressures of the inflow side and the discharge side of the compressor 12, an outdoor fan RPM detection part 53 for a rotation number per unit time (RPM), i.e., a rotation speed of an outdoor fan 16, and a control part for controlling operations of the first flow switch part 131, the second flow switch part 132, the indoor fan 16, the first outdoor expansion part 141, and the second outdoor expansion part 142 according to the indoor unit 2, the pressure detection parts 51 and 52, the outdoor fan RPM detection part 53, the refrigerant pressure, and the RPM of the outdoor fan 16.

The pressure detection parts 51 and 52 includes a high-pressure detection part 51 for detecting a pressure of the refrigerant discharged from the compressor 12 and a low-pressure detection part 52 for detecting a pressure of the refrigerant flowing into the compressor 12. Here, the pressure of the refrigerant discharged from the compressor 12 may be called a high pressure, and the pressure of the refrigerant flowing into the compressor 12 may be called a low pressure.

Referring to FIGS. 6 to 9, when the refrigerant system is operated, the compressor 12, the flow switch part 13, and the outdoor and indoor expansion parts 14 and 24 are operated according to operation modes of the refrigerant system, i.e., the full heating operation, the full cooling operation, and the simultaneous cooling/heating operation of the refrigerant system. In operation S11, it is determined whether a stable time of the refrigerant system elapses. Here, the stable time represents a minimum time taken until the whole refrigerant cycle of the refrigerant system is stabilized. The stable time may be previously set as a time taken until the refrigerant cycle of the refrigerant system is stabilized in a state where the compressor 12, the flow switch part 13, and the indoor and outdoor expansion parts 14 and 24 are operated according to the operation modes of the refrigerant system.

When the stable time of the refrigerant system elapses, a process for confirming operation states of the plurality of outdoor heat exchange units 111 and 112 is performed. Here, the operation states of the plurality of outdoor heat exchange units 111 and 112 includes a first state in which the refrigerant is condensed within the whole outdoor heat exchange units 111 and 112, a second state in which the refrigerant is evaporated within the whole outdoor heat exchange units 111 and 112, a third state in which the refrigerant is condensed within the first outdoor heat exchange unit 111 of the outdoor heat exchange units 111 and 112 and is evaporated within the second outdoor heat exchange unit 112 of the outdoor heat exchange units 111 and 112, and a fourth state in which a refrigerant flow is interrupted within the first outdoor heat exchange unit 111 and is evaporated within the second outdoor heat exchange unit 112.

In more detail, when the stable time of the refrigerant system elapses, it is determined whether all the first flow switch part 131 and the second flow switch part 132 are in an outdoor condensation state in operation S12. Here, the outdoor condensation state represents a state in which the first outdoor heat exchange unit 111 and the second outdoor heat exchange unit 112 respectively corresponding to the first flow switch part 131 and the second flow switch part 132 serve as the condensers. That is, when the flow switch part 13 is in the outdoor condensation state, the whole outdoor heat exchange units 111 and 112 are operated in the first state.

In more detail, when the first flow switch part 131 is in the outdoor condensation state, the refrigerant tube connected to the first outdoor heat exchange unit 111 communicates with the refrigerant tube corresponding to the discharge side of the compressor 12. Thus, when the first flow switch part 131 is in the outdoor condensation state, the refrigerant discharged from the compressor 12 is guided to the first outdoor heat exchange unit 111 by the first flow switch part 131. Also, when the second flow switch part 132 is in the outdoor condensation state, the refrigerant tube connected to the second outdoor heat exchange unit 112 communicates with the refrigerant tube corresponding to the inflow side of the compressor 12. Thus, when the second flow switch part 132 is in the outdoor condensation state, the refrigerant discharged from the compressor 12 is guided to the second outdoor heat exchange unit 112 by the second flow switch part 132.

Next, when all the first flow switch part 131 and the second flow switch part 132 are in the outdoor condensation state, the elapsed time is initialized in operation S13. Here, the elapsed time represents a time for maintaining a state in which the RPM of the outdoor fan 16 and the refrigerant pressure correspond to conditions described below.

In operation S14, the RPM of the outdoor fan 16 is detected. In operation S15, it is determined whether the RPM of the outdoor fan 16 is less than a reference RPM. When the RPM of the outdoor fan 16 is less than the reference RPM, the high pressure and the low pressure are detected in operation S16.

When the high pressure is less than a minimum target high pressure PH1 and the low pressure is less than a maximum target low pressure PL2 in operation S17, whether the elapsed time corresponds to a reference time is determined in operation S18.

Here, for explaining the minimum target high pressure PH1 and the maximum target low pressure PL2, FIG. 9 illustrates ranges of the high pressure and the low pressure required for optimally executing performance of the refrigerant system desired by a user. The ranges of the high pressure and the low pressure required for optimally executing the performance of the refrigerant system may be called a target pressure region S. That is, the target pressure region S represents ranges of refrigerant pressure values of the inflow and discharge sides of the compressor 12 required for performing the indoor heating and cooling operations according to the operation modes of the refrigerant system. Alternatively, the target pressure region S may represent regions corresponding to the high pressure and the low pressure in a state where heat exchange for condensing the refrigerant is balanced with heat exchange for evaporating the refrigerant as a whole in the refrigerant system.

Here, in the target pressure region S, a minimum value of the high pressure is called the minimum target high pressure PH1, and a maximum value of the high pressure is called a maximum target high pressure PH2. Also, in the target pressure region S, a minimum value of the low pressure is called the minimum target low pressure PL1, and a maximum value of the high pressure is called a maximum target low pressure PL2.

FIG. 9 illustrates four regions in which the high pressure and the low pressure get out of the target pressure region S. The four regions includes a first region A in which the high pressure is less than the minimum target high pressure PH1 and the low pressure is less than the minimum target low pressure PL1, a second region B in which the high pressure is greater than the maximum target high pressure PH2 and the low pressure is greater than the maximum target low pressure PL2, a third region C in which the high pressure is less than the minimum target high pressure PH1 and the low pressure is greater than the minimum target low pressure PL1 and less than the maximum target low pressure PL2, and a fourth region D in which the high pressure is greater than the minimum target high pressure PH1 and less than the maximum target high pressure PH2 and the low pressure is greater than the maximum target low pressure PL2.

When the high pressure and the low pressure correspond to the first region A and the third region C, it may be necessary to vary high pressure and the low pressure so that the high pressure and the low pressure are increased to correspond to the target pressure region S. Also, when the high pressure and the low pressure correspond to the second region B and the fourth region D, it may be necessary to vary the high pressure and the low pressure so that the high pressure and the low pressure are increased to correspond to the target pressure region S.

When the elapsed time is not greater than the reference time in operation S18, the RPM of the outdoor fan 16 is detected again in operation S14. That is, until the elapsed time corresponds to the reference time in operation S18, the RPM of the outdoor fan 16 is detected in operation S14 to determine whether the elapsed time is less than the reference RPM in operation S15. Also, the high pressure and the low pressure are detected in operation S16 to repeatedly perform a process for determining whether the high pressure and the low pressure are respectively less than the minimum target high pressure PH1 and the maximum target low pressure PL2.

Here, the reference RPM may be previously set as a minimum rotation speed of the outdoor fan 16. That is, the reference RPM represents a minimum value of a variable rotation speed of the outdoor fan 16. Here, the reference time may be previously set as a time at which the stabilized state of the refrigerant system may be secured. That is, when the RPM of the outdoor fan 16 is less than the reference RPM and the high pressure and the low pressure are less than the minimum target high pressure PH1 and the maximum target low pressure PL2 during the reference time, it may be understood that the PRM condition of the outdoor fan 16 and the high and low pressure conditions are satisfied in the stabilized state of the refrigerant system.

On the other hand, when the RPM is not less than the reference RPM in operation S15 or the high pressure and the low pressure are not respectively less than the minimum target high pressure PH1 and the maximum target low pressure PL2 in operation S17, it is determined again whether the stable time elapses in operation S11 unless an operation end signal of the refrigerant system is inputted in operation S20. That is, after the refrigerant cycle of the refrigerant system is stable according to the switching operation of the first flow switch part 131 in operation S11, the states of the first flow switch part 131 and the second flow switch part 132 are determined in operation S12.

However, when the elapsed time is greater than the reference time in operation S18, the second flow switch part 132 is switched into an outdoor evaporation state in operation S19. That is, a refrigerant flow direction within the second outdoor heat exchange unit 112 is switched so that the refrigerant is evaporated while passing through the second outdoor heat exchange unit 112. Also, unless the operation end signal of the refrigerant system is inputted, it is determined whether the stable time elapses.

When all the first flow switch part 131 and the second flow switch part 132 are not in the outdoor condensation state in operation S11, it is determined whether all the first flow switch part 131 and the second flow switch part 132 are in the outdoor evaporation state in operation S21. Here, the outdoor evaporation state represents a state in which the first outdoor heat exchange unit 111 and the second outdoor heat exchange unit 112 respectively corresponding to the first flow switch part 131 and the second flow switch part 132 serve as the evaporator. That is, when the flow switch part 13 is in the outdoor evaporation state, outdoor heat exchange units 111 and 112 are operated in the second state.

When all the first flow switch part 131 and the second flow switch part 132 are in the outdoor evaporation state in operation S21, the elapsed time is initialized in operation S22. After the elapsed time is initialized, the RPM of the outdoor fan 16 is detected in operation S23. Then, in operation S24, it is determined whether the detected RPM of the outdoor fan 16 is less than the reference RPM. In operation S25, the high pressure and the low pressure are detected. Here, when the high pressure is greater than the minimum target high pressure PH1 and the low pressure is greater than the maximum target low pressure PL2, it is determined whether the elapsed time is greater than the reference time in operation S27.

That is, in operation S24, the RPM of the outdoor fan 16 is detected in operation S23 to determine whether the detected RPM of the outdoor fan 16 is less than the reference RPM until the elapsed time is greater than the reference time in operation S27. Also, the high pressure and the low pressure are detected in operation S25 to repeatedly perform a process for determining whether the high pressure and the low pressure are respectively greater than the minimum target high pressure PH1 and the maximum target low pressure PL2 in operation S26.

However, when the elapsed time is greater than the reference time in operation S27, the first flow switch part 131 is switched in the outdoor condensation state in operation S28. Unless the operation end signal of the refrigerant system is inputted in operation S20, it is determined again whether the stable time elapses in operation S11.

When all the first flow switch part 131 and the second flow switch part 132 are not in the outdoor evaporation state in operation S21, the first outdoor expansion part 141 is closed and it is determined whether the second flow switch part 132 is the outdoor evaporation state in operation S29. Alternatively, the refrigerant flow within the first outdoor heat exchange unit 111 is interrupted by the first outdoor expansion part 141. Also, it is determined whether the second outdoor heat exchange unit 112 serves as the evaporator by the second flow switch part 132. That is, it is determined whether the outdoor heat exchange units 111 and 112 are operated in the fourth state.

When the first expansion part 141 is closed and the second flow switch part 132 is in the outdoor evaporation state in operation S29, the elapsed time is initialized in operation S30. In operation S31, the RPM of the outdoor fan 16 is detected. Then, in operation S32, it is determined whether the RPM of the outdoor fan 16 is less than the reference RPM. When the RPM of the outdoor fan 16 is less than the reference RPM in operation S32, the high pressure and the low pressure are detected in operation S33. Also, in operation S34, it is determined whether the high pressure and the low pressure are respectively greater than the minimum target high pressure PH1 and the maximum target low pressure PL2. When the high pressure and the low pressure are respectively greater than the minimum target high pressure PH1 and the maximum target low pressure PL2 in operation S34, it is determined whether the elapsed time is greater than the reference time in operation S35.

When the elapsed time is greater than the reference time in operation S35, the first outdoor expansion part 141 is opened and the first flow switch part 131 is switched into the outdoor evaporation state in operation S36. That is, the refrigerant flow direction within the first outdoor heat exchange unit 111 is switched so that the refrigerant is evaporated while passing through the first outdoor heat exchange unit 111. Also, unless the operation end signal of the refrigerant system is inputted, it is determined again whether the stable time elapses.

When the first outdoor expansion part 141 is closed and the second flow switch part 132 is not in the outdoor evaporation state in operation S29, it is determined whether the first flow switch part 131 is in the outdoor condensation state and the second flow switch part 132 is in the outdoor evaporation state in operation S37. Alternatively, it is determined whether the refrigerant is condensed within the first outdoor heat exchange unit 111 and is evaporated within the second outdoor heat exchange unit 112. That is, it is determined whether the outdoor heat exchange units 111 and 112 are operated in the third state.

When the first flow switch part 131 is in the outdoor condensation state and the second flow switch part 132 is in the outdoor evaporation state in operation S37, the high pressure and the low pressure are detected in operation S38. When the high pressure and the low pressure are respectively less than the minimum target high pressure PH1 and the minimum target low pressure PL1 in operation S39, the elapsed time is initialized in operation S40. In operation S41, the RPM of the outdoor fan 16 is detected. Also, in operation S42, it is determined whether the RPM of the outdoor fan 16 is less than the reference RPM. When the RPM of the outdoor fan 16 is less than the reference RPM in operation S42, the high pressure and the low pressure are detected in operation S43. When the high pressure and the low pressure are respectively less than the minimum target high pressure PH1 and the minimum target low pressure PL1 in operation S44, it is determined whether the elapsed time is greater than the reference time in operation S45.

Unless the elapsed time is greater than the reference time in operation S45, the RPM of the outdoor fan 16 is detected in operation S41 to determine whether the RPM of the outdoor fan 16 is less than the reference RPM in operation S42. Also, the high pressure and the low pressure are detected in operation S43 to repeatedly perform a process for determining whether the high pressure and the low pressure are respectively less than the minimum target high pressure PH1 and the minimum target low pressure PL1 in operation S44.

However, when the elapsed time is greater than the reference time in operation S45, it is determined whether the overall cooling load ratio of the refrigerant system is greater than a reference ratio. Here, the cooling load ratio represents a ratio of a heat exchange capacity of the indoor unit 2 operated in the cooling mode with respect to heat exchange capacities of the while indoor units 2 in the refrigerant system. If the whole indoor units 2 have the same heat exchange capacity, the cooling load ratio may be a ration of the number of indoor units 2 operated in the cooling mode with respect to the number of whole indoor units in the refrigerant system. That is, for example, the number of the whole indoor units 2 is ten and the number of indoor unit 2 operated in the cooling mode is four, the cooling load ration may be about 40%.

The reference ration represents a cooling load ratio at which optimal cooling/heating performance is executable in a case where the refrigerant cycle is performed using only the plurality of indoor units 2. In general, when the cooling load ratio is about 40%, the optimal cooling/heating performance may be executed even though the refrigerant cycle is performed using only the plurality of indoor units 2. Thus, the reference ratio may be previously set as about 40%.

When the cooling load ration of the refrigerant system is greater than the reference ration in operation S46, the first outdoor expansion part 142 is closed in operation S47. That is, a refrigerant flow toward the first outdoor heat exchange unit 111 is interrupted.

However, when the cooling load ration of the refrigerant system is not greater than the reference ratio in operation S46, the first flow switch part 131 is switched into the outdoor evaporation state in operation S48. That is, the refrigerant flow direction within the first outdoor heat exchange unit 111 is switched so that the refrigerant is evaporated while passing through the first outdoor heat exchange unit 111.

When the high pressure and the low pressure are not respectively less than the minimum target high pressure PH1 and the minimum target low pressure PL1 in operation S39, it is determined whether the high pressure and the low pressure are respectively greater than the maximum target high pressure PH2 and the maximum target low pressure PL2 in operation S49.

When the high pressure and the low pressure are respectively greater than the maximum target high pressure PH2 and the maximum target low pressure PL2 in operation S49, the elapsed time is initialized in operation S50. Then, the RPM of the outdoor fan 16 is detected in operation S51 to determine whether the RPM of the outdoor fan 16 is less than the reference RPM in operation S52. When the RPM of the outdoor fan 16 is less than the reference RPM in operation S52, the high pressure and the low pressure are detected in operation S53. Then, in operation S54, it is determined whether the high pressure and the low pressure are respectively greater than the maximum target high pressure PH2 and the maximum target low pressure PL2.

When the high pressure and the low pressure are respectively great than the maximum target high pressure PH2 and the maximum target low pressure PL2 in operation S54, the RPM of the outdoor fan 16 is detected in operation S51 to determine whether the RPM of the outdoor fan 16 is less than the reference RPM in operation S52 unless the elapsed time is greater than the reference time in operation S55. Also, the high pressure and the low pressure are detected in operation S53 to repeatedly perform a process for determining whether the high pressure and the low pressure are respectively greater than the maximum target high pressure PH2 and the maximum target low pressure PL2 in operation S54.

However, when the elapsed time is greater than the reference time in operation S55, the second flow switch part 132 is switched into the outdoor condensation state in operation S56. That is, the refrigerant flow direction within the second outdoor heat exchange unit 112 is switched so that the refrigerant is evaporated while passing through the second outdoor heat exchange unit 112. Unless the operation end signal of the refrigerant system is inputted, it is determined again whether the stable time elapses.

However, when the first flow switch part 131 is in the outdoor condensation state and the second flow switch part 132 is not in the outdoor evaporation state in operation S37, it is determined again whether the stable time elapses in operation S11 unless the operation end signal of the refrigerant system is inputted in operation S20.

According to the refrigerant system and the method for controlling the same, there has an advantage in that heat transfer efficiency of the refrigerant system may be optimally maintained regardless of the operation mode switching of the indoor unit 2. In detail, the operation mode of the indoor unit 2 may be switched during the operation of the refrigerant system. That is, a ratio of the indoor unit 2 operated in the cooling mode and the indoor unit 2 operated in the heating mode of the plurality of indoor units 2 may be varied. The refrigerant pressure of the inflow side and the refrigerant pressure of the discharge side of the compressor 12 are varied according to the ratio of the indoor unit 2 operated in the cooling mode and the indoor unit 2 operated in the heating mode of the plurality of indoor units 2. That is, the high pressure and the low pressure may be changed.

The more the number of indoor units 2 operated in the cooling mode among the plurality of indoor units 2 is increased, the more possibility in which the high pressure and the low pressure correspond to the second region C and the fourth region D is increased. On the other hand, the more the number of indoor units operated in the heating mode among the plurality of indoor units is increased, the more possibility in which the high pressure and the low pressure correspond to the first region A and the third region C is increased.

This is done because the number of the plurality of indoor heat exchangers and the plurality of outdoor heat exchange units 111 and 112, which serve as the condenser or the evaporator, is significantly increased as a whole in the refrigerant system. That is, this is done because in the refrigerant system, one of the amount of evaporated refrigerant and the amount of condensed refrigerant is significantly greater than that of the other one.

However, according to the refrigerant system and the method for controlling the same, when the high pressure and the low pressure correspond to one of the first region A and the third region C, the number of outdoor heat exchange units used as the evaporator in the plurality of outdoor heat exchange units 111 and 112 is increased. On the other hand, when the high pressure and the low pressure correspond to one of the second region B and the fourth region D, the number of outdoor heat exchange units used as the condenser in the plurality of outdoor heat exchange units 111 and 112 is increased.

Thus, as a whole in the refrigerant system, the heat exchange for evaporating the refrigerant circulating in the refrigerant system and the heat exchange for condensing the refrigerant circulating in the refrigerant system are balanced with each other. That is, the high pressure and the low pressure getting out of the target pressure region S may be induced to correspond to the target pressure region S. Therefore, the overall heat transfer efficiency of the refrigerant system may be optimally maintained regardless of the operation mode switching of the indoor unit 2.

The RPM detection and determination processes of the outdoor fan and the high and low pressure detection and determination processes, which are repeatedly performed until the elapsed time is greater than the reference time, may be performed in different order.

One or more embodiments herein provide a refrigerant system improving overall heat transfer efficiency and a method for controlling the same.

In one embodiment, a refrigerant system includes: an outdoor unit including an outdoor heat exchanger including a plurality of outdoor heat exchange units in which outdoor air and a refrigerant are heat-exchanged with each other and a compressor compressing the refrigerant; a plurality of indoor units each including a plurality of indoor heat exchangers in which the refrigerant and indoor air are heat-exchanged with each other; a high-pressure tube guiding the refrigerant discharged from the compressor to the indoor heat exchangers; a low-pressure tube guiding the refrigerant evaporated in at least one of the indoor heat exchangers to the compressor; a liquid refrigerant tube connected to the outdoor heat exchange units and the indoor heat exchangers to allow the refrigerant condensed in at least one of the outdoor heat exchange units and the indoor heat exchangers to flow.

Also, a pressure detection part detecting pressures of inflow and discharge sides of the compressor; and a plurality of flow switch parts respectively connected to the plurality of outdoor heat exchange units to switch a refrigerant flow direction within the plurality of outdoor heat exchange units, wherein the refrigerant flow direction is switched within at least one of the plurality of outdoor heat exchange units, based on regions corresponding to a high pressure representing a refrigerant pressure of the discharge side of the compressor and a low pressure representing a refrigerant pressure of the inflow side of the compressor.

Thus, since the number of outdoor heat exchange units used as an evaporator or condenser may be varied according to a ratio of indoor unit operated in a heating mode and indoor unit operated in a cooling mode among the plurality of indoor units, the overall heat transfer efficiency of the refrigerant system may be improved.

In accordance with another embodiment, a refrigerant system comprises an outdoor unit having a compressor and a plurality of heat exchangers; a plurality of indoor units coupled to the outdoor unit, each indoor unit having a heat exchanger; a detector to detect pressures at an inflow side and a discharge side of the compressor; and a controller to control a direction of refrigerant flow for the heat exchangers of the outdoor unit. The refrigerant flow direction for at least one of the heat exchangers of the outdoor unit is changed based on detection of the pressures at the inflow side and discharge side of the compressor by the pressure detector.

The controller determines an operational range of the system based on the detected pressures at the inflow and discharge sides of the compressor, and controls a direction of refrigerant flow for the heat exchangers of the outdoor unit based on the determined operational range.

The operational range falls into one of a plurality of ranges defined relative to a target range, the plurality of ranges including: a first range in which the discharge-side pressure and inflow-side pressure are respectively less than a first target pressure and a second target pressure; a second range in which the discharge-side pressure and the inflow-side pressure are respectively less than a third target pressure and a fourth target pressure; a third range in which the discharge-side pressure is less than the first target pressure and the inflow-side pressure is greater than the second target pressure and less than the fourth target pressure; and a fourth range in which the discharge-side pressure is greater than the first target pressure and less than the third target pressure and the inflow-side pressure is greater than the fourth target pressure, wherein the target range lies between the first and third target pressures and between the second and fourth target pressures.

When the operational range falls into the first range or third range, the refrigerant flow direction for at least one of the heat exchangers of the outdoor unit is switched to cause said at least one heat exchanger to perform an evaporation function.

When the operational range falls into the second region or fourth region, the refrigerant flow direction for at least one of the heat exchangers is switched to perform a condenser function.

The refrigerant flow direction for at least one of the heat exchangers of the outdoor unit is changed based on at least one additional factor, said factor corresponding to an operation state of at least one of the heat exchangers of the outdoor unit. The operation state of the heat exchangers of the outdoor unit fall into one of: a first state in which refrigerant is condensed by the heat exchangers; a second state in which refrigerant is evaporated by the heat exchangers; a third state in which refrigerant is condensed by a first heat exchanger and is evaporated by a second heat exchanger; or a fourth state in which refrigerant flow within the first heat exchanger is interrupted and refrigerant is evaporated by the second heat exchanger.

Operation states of the heat exchangers of the outdoor unit are varied when the operational range lies outside the target range and when a speed of a fan of the outdoor unit is less than a reference speed for a time greater than a reference time.

The controller may include a first switch coupled between a first heat exchanger of the outdoor unit and the compressor, the first switch controlling a flow direction of refrigerant between the first heat exchanger and compressor, and a second switch coupled between a second heat exchanger of the outdoor unit and the compressor, the second switch controlling a flow direction of refrigerant between the second heat exchanger and compressor. The compressor may include a first compression part to operate at substantially constant speed and a second compression part to operate at a variable speed.

The controller controls the flow direction of refrigerant to cause the heat exchangers of the outdoor unit to operate in heating mode, refrigerant flowing from the heat exchangers through the compressor to the heat exchanger in each of the indoor units.

The controller controls the flow direction of refrigerant to cause the heat exchangers of the outdoor unit to operate in cooling mode, refrigerant flowing from the compressor into the heat exchangers and from the heat exchangers to each of the indoor units.

The controller controls the flow direction of refrigerant to cause a first heat exchanger of the outdoor unit to operate in heating mode and a second heat exchanger of the outdoor unit to simultaneously operate in cooling mode.

The detector may includes a first detection part to detect pressure at the inflow side of the compressor and a second detection part to detect pressure at the discharge side of the compressor.

In accordance with another embodiment, a method for controlling a refrigeration system comprises confirming operation states of a plurality of heat exchangers; detecting refrigerant pressure at a discharge side and refrigerant pressure of an inflow side of a compressor; and controlling the operation state of at least one of the heat exchangers based on the detected pressures, said controlling including changing a flow direction of refrigerant of said at least one heat exchanger based on the detected refrigerant pressures.

The controlling operation includes determining an operational range of the system based on the detected pressures, wherein the flow direction of refrigerant of said at least one heat exchanger is changed based on the detected pressures.

The operational range falls into one of a plurality of ranges defined relative to a target range, the plurality of ranges including: a first range in which the discharge-side pressure and inflow-side pressure are respectively less than a first target pressure and a second target pressure; a second range in which the discharge-side pressure and the inflow-side pressure are respectively less than a third target pressure and a fourth target pressure; a third range in which the discharge-side pressure is less than the first target pressure and the inflow-side pressure is greater than the second target pressure and less than the fourth target pressure; and a fourth range in which the discharge-side pressure is greater than the first target pressure and less than the third target pressure and the inflow-side pressure is greater than the fourth target pressure, wherein the target range lies between the first and third target pressures and between the second and fourth target pressures.

The method may also include detecting a speed of a fan and comparing the fan speed to a reference speed, wherein the operation state of the at least one heat exchanger is controlled based on the detected pressures and a result of the comparison.

Each of the heat exchangers may fall into one of a plurality of operation states comprising: a first state in which refrigerant is condensed within the heat exchangers, a second state in which refrigerant is evaporated within the heat exchangers, a third state in which refrigerant is condensed within a first heat exchanger and evaporated within a second heat exchanger.

The heat exchangers may correspond to an outdoor unit. The flow direction of refrigerant may be controlled to cause the heat exchangers to operate in heating mode, and flow of the refrigerant from at least one of the heat exchangers passes through a compressor and directed to a heat exchanger of an indoor unit.

The flow direction of refrigerant may be controlled to cause the heat exchangers to operate in cooling mode, and wherein refrigerant flows from a compressor into the heat exchangers and from the heat exchangers to at least one indoor unit.

The flow direction of refrigerant may be controlled to cause a first heat exchanger to operate in heating mode and a second heat exchanger to simultaneously operate in cooling mode.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. The features of any one embodiment may be combined with the features of one or more of the other embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling a refrigeration system, comprising:

confirming a first operation state of first and second outdoor heat exchangers of an outdoor unit;

initializing an elapsed time;

detecting rpm of an outdoor fan;

detecting an inflow side pressure and a discharge side pressure of a compressor if the detected rpm of the outdoor fan is below a reference rpm;

determining whether the elapsed time corresponds to a reference time if the discharge side pressure and the inflow side pressure of the compressor are detected in a predetermined range; and switching an operation state of the first and second outdoor heat exchangers from the first operation state to a second operation state, wherein the switching of the operation state of the first and second outdoor heat exchangers comprises:

controlling a direction of refrigerant flow for the first and the second heat exchangers of the outdoor unit using a first and a second flow switch to adjust the discharge-side pressure and the inflow-side pressure to a target range, the first flow switch and the second flow switch being connected to the first and the second heat exchangers, respectively, wherein the target range is defined in a range in which the discharge-side pressure is greater than a first target pressure and less than a third target pressure and the inflow-side pressure is greater than a second target pressure and less than a fourth target pressure.

2. The method of claim 1, wherein:

when the first and second flow switches are operated to respectively introduce the refrigerant compressed at the compressor into an indoor heat exchanger of an indoor unit, and the discharge-side pressure is greater than the first target pressure, and the inflow-side pressure is greater than the fourth target pressure, the controlling comprises introducing the refrigerant compressed at the compressor into the first outdoor heat exchanger.

3. The method of claim 1, wherein:

when a first outdoor expansion part disposed at a side of the first outdoor heat exchanger closes, the second flow switch is operated to introduce the refrigerant compressed at the compressor into an indoor heat exchanger of an indoor unit, the discharge-side pressure is greater than the first target pressure and the inflow-side pressure is greater than the forth target pressure, the controlling comprises opening the first outdoor expansion part such that the first outdoor heat exchanger serves as an evaporator.

4. The method of claim 1, wherein:

when the first flow switch is operated to introduce the refrigerant compressed at the compressor into the first outdoor heat exchanger, the second flow switch is operated to introduce the refrigerant compressed at the compressor into an indoor heat exchanger of an indoor unit, the discharge-side pressure is less than the first target pressure, the inflow-side pressure is less than the second target pressure and a cooling load ratio of the refrigeration system is greater than a reference ratio of the refrigeration system, the controlling comprises closing a first outdoor expansion part disposed at a side of the first outdoor heat exchanger, wherein the cooling load ratio represents a ratio of a heat exchange capacity of the indoor unit operated in the cooling mode with respect to heat exchange capacities of indoor units provided in the refrigeration system.

5. The method of claim 1, wherein:

when the first flow switch is operated to introduce the refrigerant compressed at the compressor into the first outdoor heat exchanger, the second flow switch is operated to introduce the refrigerant compressed at the compressor into an indoor heat exchanger of an indoor unit, the discharge-side pressure is less than the first target pressure, the inflow-side pressure is less than the second target pressure, and a cooling load ratio of the refrigeration system is less than a reference ratio, the controlling comprises adjusting the first flow switch such that the refrigerant compressed at the compressor is introduced into the indoor heat exchanger, and wherein the cooling load ratio represents a ratio of a heat exchange capacity of the indoor unit operated in the cooling mode with respect to heat exchange capacities of indoor units provided in the refrigeration system.

6. The method of claim 1, wherein:

when the first flow switch is operated to introduce the refrigerant compressed at the compressor into the first outdoor heat exchanger, the second flow switch is operated to introduce the refrigerant compressed at the compressor into an indoor heat exchanger of an indoor unit, the discharge-side pressure is greater than the third target pressure, the inflow-side pressure is greater than the fourth target pressure, and a cooling load ratio of the refrigeration system is less than a reference ratio, the controlling comprises adjusting the second flow switch such that the refrigerant compressed at the compressor is introduced into the second outdoor heat exchanger, and wherein the cooling load ratio represents a ratio of a heat exchange capacity of the indoor unit operated in the cooling mode with respect to heat exchange capacities of indoor units provided in the refrigeration system.

7. The method of claim 1, wherein:

the reference RPM is set as a minimum rotation speed of the outdoor fan.

8. The method of claim 1, wherein:

the reference time is set as a time at which a stabilized state of the refrigerant system is secured.

9. The method of claim 1, further comprising:

maintaining the operation state of the first and second outdoor heat exchangers at the first operation state if the detected rpm of the outdoor fan is above the reference rpm.

10. The method of claim 1, further comprising:

maintaining the operation state of the first and second outdoor heat exchangers at the first operation state if the discharge side pressure and the inflow side pressure of the compressor are detected in a range except the predetermined range.

* * * * *